US005118439A

United States Patent [19]

Urfer et al.

[11] Patent Number: 5,118,439

[45] Date of Patent: Jun. 2, 1992

[54] PROCESS FOR PREPARING A DETERGENT SLURRY AND PARTICULATE DETERGENT COMPOSITION

[75] Inventors: Allen D. Urfer; Gail M. Howell, Decatur, both of Ill.

[73] Assignee: Henkel Corporation, Ambler, Pa.

[21] Appl. No.: 597,296

[22] Filed: Oct. 12, 1990

Related U.S. Application Data

[63] Continuation of Ser. No. 260,646, Oct. 19, 1988, abandoned.

[51] Int. Cl.[5] ..... C11D 17/00; B01F 17/02

[52] U.S. Cl. ..... 252/174.17; 252/174.18; 252/353

[58] Field of Search ..... 252/174.18, 353, 174.17

[56] References Cited

U.S. PATENT DOCUMENTS

| | | | |
|---|---|---|---|
| 3,954,679 | 5/1976 | Wixon | 252/555 |
| 4,675,127 | 6/1987 | Kickle | 252/174.17 |
| 4,806,275 | 2/1989 | Johnson | 252/554 |

*Primary Examiner*—A. Lionel Clingman
*Assistant Examiner*—William S. Parks
*Attorney, Agent, or Firm*—Ernest G. Szoke; Wayne C. Jaeschke; Daniel S. Ortiz

[57] ABSTRACT

The invention is a process for preparing a carbonate containing detergent slurry with reduced viscosity by incorporating in the detergent slurry from 0.5 to 10% of an alkylpolyglycoside and 0.5 to 10% of an alkali metal chloride, the percentage being by weight of the non-aqueous portion of the slurry.

20 Claims, 4 Drawing Sheets

PROCESS FOR PREPARING A DETERGENT SLURRY AND PARTICULATE DETERGENT COMPOSITION

This application is a continuation of application Ser. No. 260,646, filed on Oct. 21, 1988, now abandoned.

BACKGROUND OF THE INVENTION

1. Field of the Invention

The invention relates to preparation of aqueous detergent slurries with reduced viscosity. This invention also relates to preparation of a particulate detergent and the novel detergent composition.

Particulate detergent compositions are generally prepared by forming an aqueous slurry of the materials which form the detergent and drying the slurry. The slurry of the detergent forming composition is generally formed in a apparatus called a crutcher. Since the water present in the slurry must be removed to form a particulate detergent, the slurry generally has as low a concentration of water as permitted by the required handling of the slurry in the drying operation.

Detergent compositions generally comprise at least one surfactant, detergent builders such as phosphates, maleic acid/vinyl ether copolymers, silicates, carbonates, salts of nitrilotriacetic acid, zeolites and the like, fillers such as sodium sulfate, sodium chloride and various additives which prevent redeposition, brighten the clothes, chelate metal ions and the like.

2. Statement of Related Art

It is known that the inclusion of a small amount of alkyl glycosides and particularly alkyl polyglycosides in phosphate built detergent slurry compositions, reduces the slurry viscosity so that a higher concentration of the non-aqueous ingredients can be included in the slurry. U.S. Pat. No. 4,675,127, which is incorporated herein by reference, discloses phosphate built detergent compositions containing small amounts of alkyl polyglycosides to reduce the viscosity of the slurry and permit inclusion of a higher concentration of the non-aqueous ingredients in the slurry. U.S. Pat. No. 4,536,319 which is incorporated herein by reference discloses detergent compositions containing alkyl polyglycoside surfactant and a co-surfactant.

With the advent of environmental concerns, many locales have banned the use of phosphates in detergent compositions or severely limited the amount of phosphate which can be present. One of the detergent builders which has been substituted for the now banned phosphates is sodium carbonate. The inclusion of alkyl polyglycosides alone in a carbonate built detergent composition, does not have the effect of substantially reducing the viscosity of the slurry. Accordingly, slurries containing higher proportions of water are required so that the detergent slurry can be handled and transported to the drying apparatus. The inclusion of the additional water in the detergent slurry reduces the capacity of the drying apparatus and increases the cost of preparing the particulate detergent composition.

BRIEF DESCRIPTION OF THE INVENTION

Other than in the operating examples, or where otherwise indicated, all numbers expressing quantities of ingredients or reaction conditions used herein are to be understood as modified in all instances by the term "about".

It is been unexpectedly discovered that the viscosity of a carbonate containing and particularly a carbonate built detergent slurry can be substantially reduced by including in the detergent slurry composition a viscosity reducing amount of an alkyl polyglycoside and an alkali metal chloride. The viscosity of a detergent slurry containing a zeolite can also be reduced by addition of alkyl polyglycoside and an alkali metal chloride to the detergent slurry.

The process for preparing a particulate detergent composition of the present invention comprises forming an aqueous slurry comprising per 100 parts of total slurry weight:

(1) from 15 to 50 parts by weight of water; and (2) from 50 to 85 parts by weight of a non-aqueous composition, the non-aqueous composition comprises:

a. from about 2% to 50% by weight of an anionic surfactant, a nonionic surfactant or mixture thereof;

b. from about 10% to about 70% by weight of an alkali metal carbonate builder;

c. from about 0 to about 50% by weight of at least one supplemental builder;

d. from about 0 to about 60% by weight of at least one filler;

e. from about 0 to about 15% by weight of at least one additive;

f. at least a viscosity reducing amount of at least one alkyl glycoside and an alkali metal chloride;

B. drying the slurry to form the particulate detergent composition.

The invention also includes a slurry having the above composition and a particulate detergent formed from the dried slurry. The slurry is preferably dried by spray drying.

DETAILED DESCRIPTION OF THE INVENTION

Figure 1:
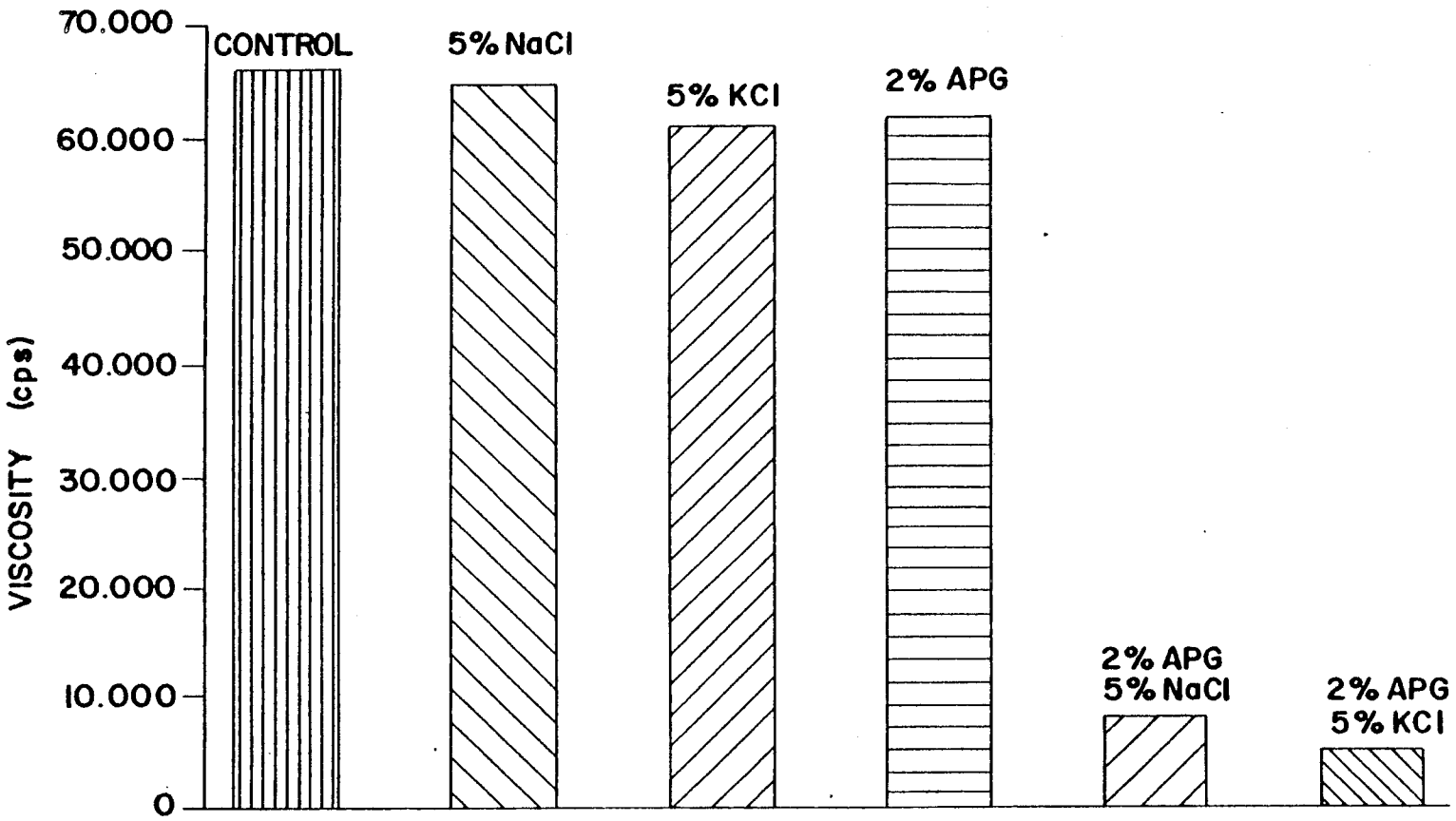
FIG. 1 is a bar graph illustrating a comparison of the viscosity of carbonate built detergent slurries containing alkali metal chlorides, alkyl polyglycoside and a mixture of alkali metal chloride and alkyl polyglucoside.

All percentages shown are by weight unless otherwise noted.

U.S. Pat. No. 4,675,127 discloses that the addition of alkyl polyglycoside to a detergent slurry containing a phosphate builder substantially reduces the viscosity of the slurry. The amount of water in the slurry can be reduced to form a slurry with a higher concentration of active ingredients having a viscosity which still permits handling of the detergent slurry with normal handling equipment. That is, the addition of more non-aqueous materials to the alkyl polyglycoside containing slurry produces a slurry with a viscosity and pumpability not higher than a slurry of lower concentration not containing the alkyl polyglycoside. However, alkyl polyglucoside alone does not substantially reduce the viscosity of carbonate containing detergent slurries.

Applicants have unexpectedly discovered that the combination of alkyl glycoside and particularly an alkyl polyglycoside and an alkali metal chloride substantially reduces the viscosity of carbonate containing and particularly carbonate built detergent slurries. The discovery is unexpected since the addition of either alkyl glycoside or an alkali metal chloride salt alone to a carbonate containing detergent slurry does not substantially reduce the viscosity of the slurry and, in some cases, actually increases the viscosity. The phrase "carbonate built" detergent slurry refers to a slurry wherein a major portion of the builder is an alkali metal carbonate, bicarbonate, sesquicarbonate or mixture thereof. A carbonate containing detergent slurry is one in which the alkali metal carbonate, bicarbonate or sesquicarbonate is present but does not comprise more than 50% of the builder.

The inclusion of alkyl glycoside and the alkali metal chloride in the carbonate built or carbonate containing detergent slurry also stabilizes the slurry so that the viscosity of the slurry does not substantially increase over the period of time between the detergent slurry preparation and transfer to the drying apparatus. Generally, the viscosity of a detergent slurry increases as the detergent slurry ages. This is particularly critical in low water slurries. Low water slurries as they age and the ingredients hydrate tend to become granular and can set up as a solid material. The addition of alkyl glycoside and alkali metal chloride to the detergent slurries of the invention permits the slurry to remain fluid over long periods of time. Even when the viscosity of the carbonate containing slurry does not require reduction, the addition of alkyl glycoside and preferably alkyl polyglycoside and alkali metal chloride improves the texture and handleability of the slurry.

In the past, when it was necessary to hold the slurry in the crutcher due to malfunctioning of plant equipment, the slurry had to be diluted to prevent setting-up of the slurry as a solid material. The present invention precludes such an occurrence. The present invention can be practiced as an emergency measure wherein a mixture of alkyl glycoside and alkali metal chloride can be introduced into the slurry and mixed therewith to prevent the slurry from setting-up during a plant emergency.

The addition of alkyl glycoside and the alkali metal chloride to a detergent composition containing a nonionic surfactant can aid in homogenizing the slurry and preventing separating out or oiling out of the nonionic surfactant. Generally, detergent slurries are prepared at an elevated temperature in a range of about 130 to about 175° F. The solubility of nonionic surfactants detergent slurry preparation temperature, the nonionic surfactants, if present in substantial quantities, tend to separate from the detergent slurry and form a discontinuous or oily phase. The addition of alkyl glycoside and the alkali metal chloride aid in dispersing the nonionic surfactant throughout the detergent slurry.

The non-aqueous portion of the detergent slurry of the present invention comprises from 2 to 50% by weight of an anionic surfactant, a nonionic surfactant or a mixture thereof. Preferably, the surfactant is present at from about 8 to about 25% by weight and more preferably from about 10 to 20% by weight. Preferably, the detergent slurry comprises an anionic surfactant or a mixture of an anionic surfactant and nonionic surfactant in a ratio of from 5:1 to about 1:2 on a weight basis.

Typical anionic surfactants which can be included in the composition of the present invention include linear or branched alkylaryl sulfonates or derivatives thereof (alkylbenzenesulfonate, alkyltoluenesulfonate, alkylphenolsulfonates and the like). Metal (especially alkali metal) salts of fatty acids (commonly referred to as "soaps"); alcohol sulfates; alcohol ether sulfates; alkane sulfonates; alkene sulfonates; alpha sulfo methyl fatty esters; and the like. Anionic surfactants are well known in the art. The preferred anionic surfactants are alkyl aryl sulfonate salts.

The nonionic surfactants useful in the composition of the present invention include alkoxylated (especially ethoxylated and mixed ethoxylated, propoxylated adducts of primary or secondary fatty ($C_8$–$C_{20}$) alcohols, alkoxylated alkylphenols, fatty alkanolamides, and the like. Nonionic surfactants are well known in the art and a detailed explanation of their structures and use will not be presented here.

Mixtures of anionic and nonionic surfactants are particularly preferred since the detergents containing such mixtures maintain the advantageous and desirable properties of both the anionic and the nonionic surfactants.

The alkali metal carbonates are present in the non-aqueous portion of the composition at from about 15 to about 70% by weight and preferably from about 30 to about 60% by weight and more preferably from about 40 to about 55% by weight. The alkali metal carbonates act as detergent builders. Preferably, the alkali metal carbonate is sodium carbonate. The phrase carbonate as used herein encompasses alkali metal carbonate, bicarbonate, and sesquicarbonate preferably the carbonate is sodium carbonate or bicarbonate.

The non-aqueous portion of the detergent composition of the present invention can also contain additional builders which include the known builder materials conventionally employed in the manufacture of powder or granular detergent products. Examples of such builder ingredients include alkali metal citrates, alkali metal silicates, alkali metal nitrilotriacetates, carboxymethyloxy-succinates, zeolites and the like. Preferably additional builders are present at from 15–40% by weight. The composition of the present invention can contain minor amounts of phosphate builders. However, inclusion of more than 20% by weight of the non-aqueous portion of the composition of a phosphate builder can unduly increase the viscosity of the slurry. The present invention is useful for reducing the viscosity of slurries containing a major portion of a zeolite builder containing a carbonate builder.

The detergent slurry of the present invention can contain filler materials. Filler materials are generally watersoluble materials which do not adversely affect the detergent properties of the mixture. Filler materials are generally neutral water soluble compositions such as sodium sulfate and sodium chloride Fillers can be present up to 60% by weight of the nonaqueous portion of the detergent composition. Preferably the fillers are present at from 15 to 35% by weight and most preferably from 20 to 30% by weight of the non-aqueous portion of the detergent composition. The filler materials are well known in the art. Sodium sulfate is a well known filler.

The detergent composition can contain up to 20% by weight of at least one additive. Additives are materials such as anti-redeposition agents, fragrances, chelating agents, complexing agents, colorants, foam stabilizers, organic solvents, whitening agents, brightening agents and the like. Preferably additives are present at from 0.5 to about 5%. The additive compositions useful in detergent formulations are well known to those skilled in the art and will not be set out in detail in this application.

The composition of the present invention must contain at least a viscosity reducing amount of an alkylglycoside and an alkali metal chloride. Generally, from about 0.5 to about 10% by weight of the alkylglycoside is sufficient to reduce the viscosity of the detergent slurry composition when used with from about 0.5 to about 10% by weight of an alkali metal chloride. Both the alkylglycoside and the alkali metal chloride must be present to achieve the substantial viscosity reducing effects in the detergent slurry composition of the present invention.

The alkylglycoside surfactants suitable for use in the practice of the present invention include glycosides of the formula:

$$RO—(R^1O)_y—(G)_xZ_b$$

wherein

R is a monovalent organic radical containing from about 6 to about 30 (preferably from about 8 to about 18) carbon atoms;

$R^1$ is a divalent hydrocarbon radical containing from about 2 to about 4 carbon atoms;

O is an oxygen atom;

y is a number which has an average value from about 0 to about 1 and is preferably 0;

G is a moiety derived from a reducing saccharide containing 5 or 6 carbon atoms; and x is a number having an average value from about 1 to 5 (preferably from 1.1 to 2).

Z is $O_2M$, $$\overset{O}{\overset{\|}{OC}}—R^2$$

$O(CH_2)_pCO_2M$, $OSO_3M$, $O(CH_2)_pSO_3M$;

$R^2$ is $(CH_2)_2CO_2M$ or $CH=CHCO_2M$; Z can be $O_2M$ only if Z is in place of a primary hydroxyl group in which the primary hydroxyl-bearing carbon atom, $—CH_2OH$ is oxidized to form a $$—\overset{O}{\overset{\|}{C}}—OM$$

group;

b is a number of from 1 to 3x+1 preferably an average of from 0.5 to 2 per glycosal group;

p is 1 to 10.

M is $H^+$ or an organic or inorganic cation such as alkali metal, ammonium, monoethanolamine or calcium.

Alkyl glycosides containing Z substituents and their method of preparation are disclosed in United States Application Ser. No. 86,990 filed Aug. 19, 1987 which is now U.S. Pat. No. 4,806,275, which is incorporated herein by reference.

R is generally the residue of a fatty alcohol having from about 8–30 and preferably 8–18 carbon atoms.

A particularly preferred group of glycoside surfactants for use in the practice of the invention include alkylpolyglycoside compositions in which R is a monovalent aliphatic radical (linear or branched) containing from 8 to 18 carbon atoms; y is zero; G is a an average value of from about 1.0 to about 2.0.

The alkylpolyglycosides can contain a glycosal moiety which is selected from group consisting of fructose, glucose, manose, galactose, talose, gulose, allose, altose, itose, aribanose, xylose, luxose, ribose and mixtures thereof. Preferably the glycosal moiety is a glucose moiety.

A viscosity reducing amount of the alkylglycoside generally ranges from 0.5 to 10% by weight of the non-aqueous portion of the detergent composition. However, detergent compositions containing more than 10% of the alkylglycoside are also encompassed within the present invention. The alkylglycoside is a surfactant per se and can be utilized in higher amounts. However, suitable viscosity reduction can generally be obtained in the range from about 0.5 to about 8% by weight. Preferably the alkylglycoside is an alkyl polyglycoside and most preferably an alkyl polyglucoside.

The alkali metal chloride salts when used with the alkylgly-cosides in the practice of the present invention substantially reduce the viscosity of the aqueous detergent slurry composition of the present invention. Generally, the alkali metal chlorides are present in from about 0.5 to about 10% by weight of the composition. Greater amounts of alkali metal chloride can be present in the composition. Preferably the alkali metal chloride is sodium chloride, potassium chloride or mixtures thereof.

It has been discovered that inclusion of the alkylglycoside and the alkali metal chloride salt in the detergent composition can reduce the water content of the slurry up to 30% or more without a significant increase in the viscosity of the slurry. Reduction in the water content of the slurry results in a concommittant increase in the throughput of the drying apparatus since a substantial portion of the thermal load of a drying apparatus is utilized to provide the latent heat of vaporization for the water which is removed from the detergent slurry to form the particulate detergent composition. The preferred method of drying is spray drying which is well known in the art and will not be further described here.

The higher solids content also tends to produce a dried detergent having a higher bulk density. The higher bulk density permits packaging the detergent in smaller packages and, therefore, reduces packaging and shipping costs.

The discovery of the present invention is unexpected since neither the alkylglycoside nor the alkali metal chloride alone have a substantial viscosity reducing effect on the detergent slurry of the invention. Only the combination of the alkylglycoside and the alkali metal chloride substantially reduces the viscosity of the detergent slurry composition.

The detergent slurry compositions with the reduced viscosity are prepared by adding the surfactants, the alkylglycoside, the alkali metal chloride and any other liquid or minor amounts of dry ingredients to the water for forming the slurry. The water containing the materials is agitated, and the dry ingredients which are to be added in major proportions are mixed with the aqueous portion. It takes a short period of mixing, generally from 5 to 25 minutes, to form a slurry with a generally stable viscosity. During the initial mixing period, when the dried ingredients are being hydrated with the water in the mixture, the viscosity of the detergent slurry can vary. After a period of about 25 minutes of mixing the viscosity of the slurry generally stabilizes. At this point, a comparison of viscosities of slurries of substantially the same composition and solid content with and without the alkylglycosides and alkali metal chloride, shows that the viscosity of the detergent slurry of the invention is substantially lower than the equivalent slurry not containing the alkylglycoside and the alkali metal chloride.

In the examples which follow, the slurries were prepared in a 600 ml tall form beaker using 420 to 470 g of non-aqueous ingredients. A LIGHTNIN ® mixer having a single, three blade stirrer (2 inches in diameter) positioned one half inch from the bottom of the beaker was used for mixing. The mixer was attached to a Variac ® power control unit so that the mixing could be done at the highest possible speed without entraining air into the slurry. Air causes the slurry viscosity to increase.

The beaker was placed in a constant temperature water circulating bath maintained at 160° F. Water was introduced into the beaker, and the surfactants, silicates, alkyl glycosides and alkali metal chloride along with any additives were mixed with the water. The sodium carbonate and any other builders and fillers were then added to the aqueous mixture in the beaker over a 10 minute period. The maximum mixing speed was attained before all the ingredients were added. The maximum mixer speed was about 2000 rpm as measured by a strobe light.

The stirring at the maximum mixing speed was continued for 5 minutes after all dry ingredients had been added. The viscosity was measured after the slurry had set for 10 minutes. The slurry was then mixed for an additional 20 minutes, and a second viscosity taken. Some slurries were mixed for a second 20 minute period and some were permitted to sit for 16 hours at 160° F., then stirred and the viscosity measured. Since the viscosity was relatively stable and did not change significantly after the first 20 minute mixing period, the viscosities reported are shown as the 5 minute and the 25 minute mixing periods.

The viscosities of the slurry were measured by an RVT model viscosimeter mounted on a Brookfield Helipath Stand. The Brookfield Helipath Stand slowly lowers the viscosimeter into the slurry, so that the rotating shearing spindle describes a helical path through the test sample. The readings were taken in the bottom half of the slurry to minimize the effect of mixture lost or crust formation on the top of the slurry. A minimum of ten readings were taken on average to get a representative viscosity.

The slurry composition and the results of the tests are shown in the examples and the Figures.

EXAMPLES

Example 1

The experiment reported in FIG. 1 was done to determine the effect of sodium chloride, potassium chloride, alkyl polyglucoside and a mixture of alkyl polyglucoside and sodium chloride and alkyl polyglucoside and potassium chloride on the viscosity of a slurry. The slurry was prepared utilizing an anionic surfactant and sodium carbonate. The slurry contained 28% water and 72% by weight of the following compositions:

| | Control Percent | APG Percent |
|---|---|---|
| NaLAS[1] | 15 | 15 |
| $Na_2CO_3$ | 55 | 55 |
| $Na_2SO_4$ | 23 | 21-16 |
| Sodium Silicate[3] | 7 | 7 |
| APG TM 500[2] | 0 | 2 |
| KCl/NaCl | 0 | 5 |

[1]NaLAS is dodecylbenzene sulfonate sodium salt sold under the Tradename C-560 Slurry from Vista Chemical Company.
[2]APG ® 500 is an alkylpolyglucoside with a 12-13 carbon alkyl group and degree of polymerization (DP) of less than 1.4.
[3]Sodium Silicate was 47% solids with a 1:2.4 $Na_2O/SiO_2$ ratio sold under Tradename Ru from Philadelphia Quartz Corporation. The sodium silicate was used in all of the examples.

A slurry was prepared first with no additives having the composition shown under Control. A second slurry was prepared substituting 5% of sodium chloride for 5% of the sodium sulfate in the formulation. A second formulation wherein 5% of potassium chloride was substituted for 5% of the sodium sulfate in the formulation. A fourth formulation was prepared in which 2% APG ® 500 was substituted for 2% of the sodium sulfate in the formulation. A fifth formulation was prepared in which 2% APG ® 500 and 5% sodium chloride were substituted for 7% of the sodium sulfate in the composition. A sixth formulation was prepared wherein 2% APG ®and 5% potassium chloride was substituted for 7% of the sodium sulfate. The slurries contained 28% water and 72% by weight of the formulation.

FIG. 1 clearly shows the unexpected reduction in the viscosity of the slurry when both APG ® 500 and alkali metal chloride were present in the detergent slurry mixture. The results are completely unexpected since neither an alkali metal chloride nor APG ® 500 alone substantially affected the viscosity of the detergent slurry.

The values for the viscosities shown on the bar graph of FIG. 1 are as follows:

| Bar | Viscosity (CPS) |
|---|---|
| Control | 66,200 |
| NaCl | 65,000 |
| KCl | 61,000 |
| 2% APG | 62,000 |
| 2% APG-5% NaCl | 8,000 |
| 2% APG-5% KCl | 5,000 |

Example 2

In this example, six slurries were prepared to determine the effect of alkyl chain length and degree of polymerization (DP) on the viscosity of a anionic detergent, carbonate built system containing 28% water. The slurry is noted as containing 72% solids by weight. The solids are the portion which remains after removal of water. Not all of the materials are necessarily solids but can be viscous liquids.

The slurries were prepared as described above and the viscosities measured after 25 minutes of stirring at 2000 rpm.

The alkyl polyglycoside was of the formula $RO—(R^1O—)_yG_x$ wherein y was equal to 0, Z was a glucose residue and x is the degree of polymerization and R is an alkyl group having from 8 to 13 carbon atoms.

| APG ® | R (Carbon Atoms) | X |
|---|---|---|
| 225 | 8-10 | 1.5-1.6 |
| 300 | 9-11 | 1.3-1.4 |
| 500 | 12-13 | <1.4 |
| 550 | 12-13 | 1.7-2 |

Figure 2:
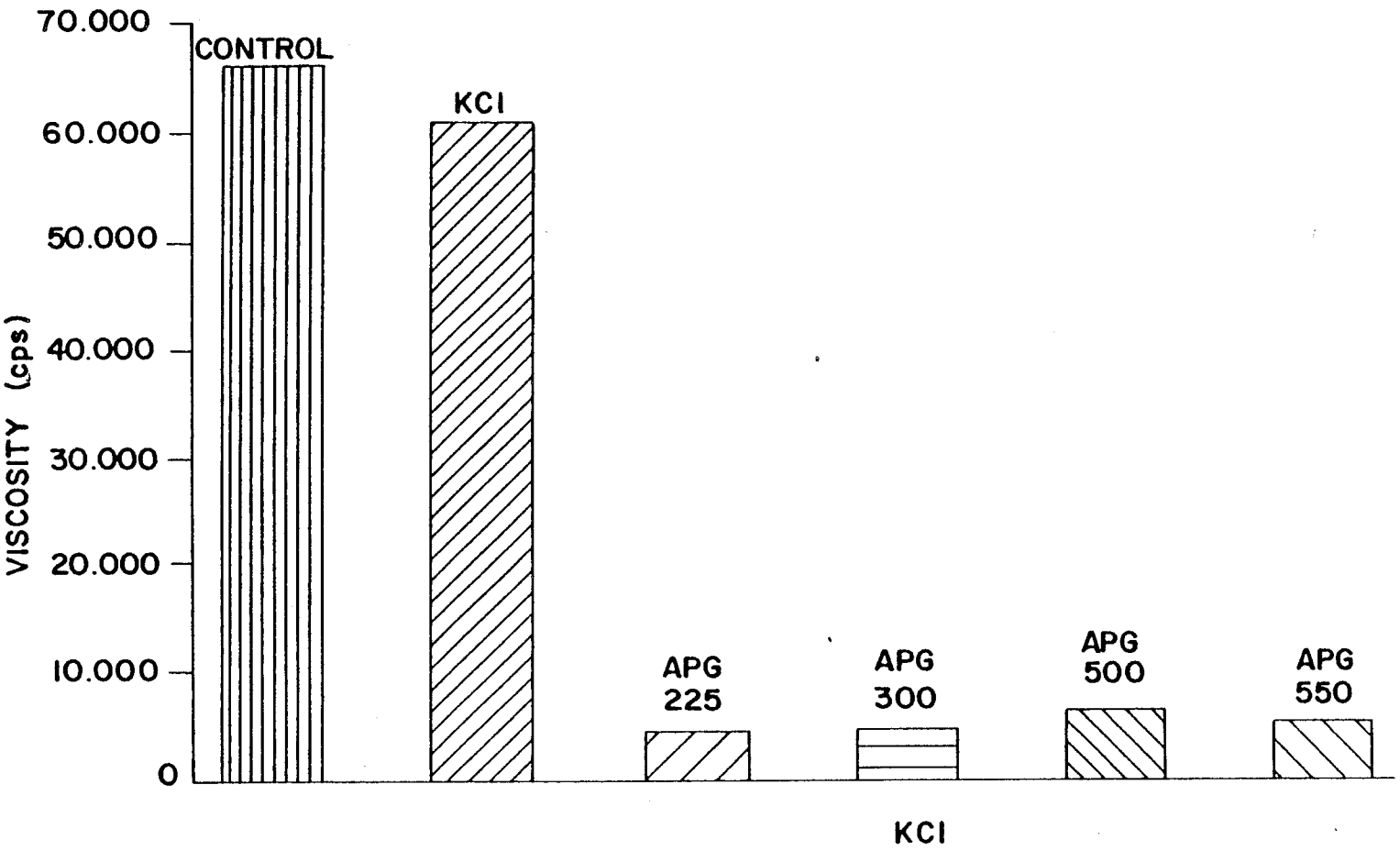
FIG. 2 is a bar graph illustrating the effect of alkali metal chloride and alkyl polyglucosides of varying compositions on the viscosity of a carbonate built detergent slurry.

The results of the experiment are shown in FIG. 2. FIG. 2 clearly shows that alkyl polyglucosides, over a broad composition range, when combined with an alkali metal chloride reduces the viscosity of a carbonate built detergent system.

The value of the viscosities shown on the bar graph were as follows:

| Bar | Viscosity (CPS) |
|---|---|
| Control | 66,200 |
| KCl | 61,000 |
| APG ® 225 | 4,600 |
| APG ® 300 | 4,700 |
| APG ® 500 | 6,400 |
| APG ® 550 | 5,400 |

Example 3

The example was carried out to show the reduction in viscosity of an anionic/nonionic surfactant carbonate built detergent system by the incorporation therein of the APG ® alkyl polyglucoside and an alkali metal chloride. A control formulation and an equivalent formulation containing APG ® were prepared. The formulations were as follows:

| | Control | APG TM |
|---|---|---|
| NaLAS[1] | 12 | 12 |
| LAE 25-7[2] | 4 | 4 |
| $Na_2CO_3$ | 55 | 55 |
| $Na_2SO_4$ | 22 | 15 |
| Sodium Silicate | 7 | 7 |
| APG ® 325 | 0 | 2 |
| KCl | 0 | 5 |

Figure 3:
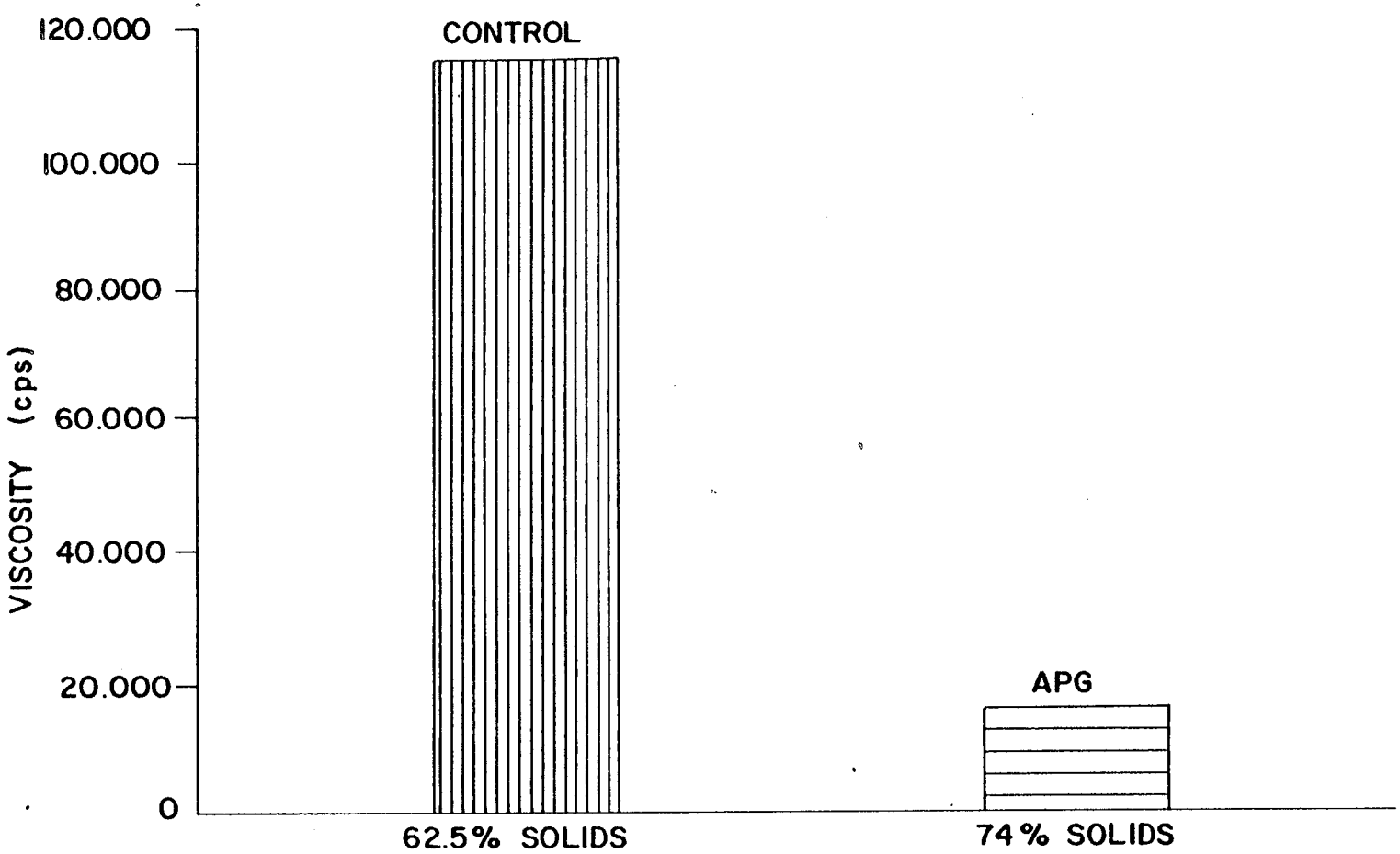
FIG. 3 is bar graph illustrating the effectiveness of alkali metal chloride and alkyl polyglucoside on the viscosity of a carbonate built detergent slurry containing an anionic and nonionic surfactant.

The formulations were the same except for the substitution of 5% of KCL and 2% APG TM 325 for 7% for the $Na_2SO_4$. FIG. 3 shows the viscosity of the control slurry containing 37.5% water and an APG and alkali metal chloride containing slurry containing 26% water. Even though the slurry containing APG ® and alkali metal chloride contained only 69% of the water in the control slurry, the viscowas only about 1/6 as high.

The values for the viscosities shown in the bar graph were as follows:

| Bar | Viscosity (CPS) |
|---|---|
| Control | 115,000 |
| APG ® | 15,500 |

The example illustrates that in a commercial operation, a slurry containing a substantially higher percentage of nonaqueous material could be processed with an increase in the efficiency of the drying apparatus. The lower viscosity would be advantageous in a spray drying process. In addition, the APG ® in the formulation aids in preventing the oiling out of the nonionic detergent.

1. NaLAS is sodium dodecylbenzene sulfonate.
2. LAE 25-7 is an ethoxylated primary alcohol nonionic surfactant sold under Trademark Neodol 25-7 from Shell Chemical Company.

Example 4

The example illustrates the effect of APG ® and potassium chloride on the viscosity of a nonionic surfactant, carbonate built detergent system. The detergent slurries were prepared and viscosities determined as described above. The results of the experiment are set forth in FIG. 4. The figure clearly shows that the combination of APG ® and potassium chloride has a substantial effect on the viscosity of the aqueous detergent slurry.

The values for the viscosities shown in the bar graph were as follows:

| | Bar | (CPS) |
|---|---|---|
| Control | 72.5% Solids | 13,700 |
| APG ® 500 | 72.5% Solids | 8,200 |
| APG ® 500 | 75% Solids | 12,100 |

The addition of the APG ® surfactant to the nonionic detergent slurry composition helps in preventing the nonionic detergent from oiling out or separating from the slurry at the elevated temperature (160° F.) used for preparing these slurries.

The formulation utilized was as follows:

| | Control | APG |
|---|---|---|
| LAE 25-7 | 12 | 12 |
| $Na_2CO_3$ | 55 | 55 |
| $Na_2SO_4$ | 26 | 19 |
| Na Silicate | 7 | 7 |
| APG TM 500 | 0 | 2 |
| KCl | 0 | 5 |

Figure 4:
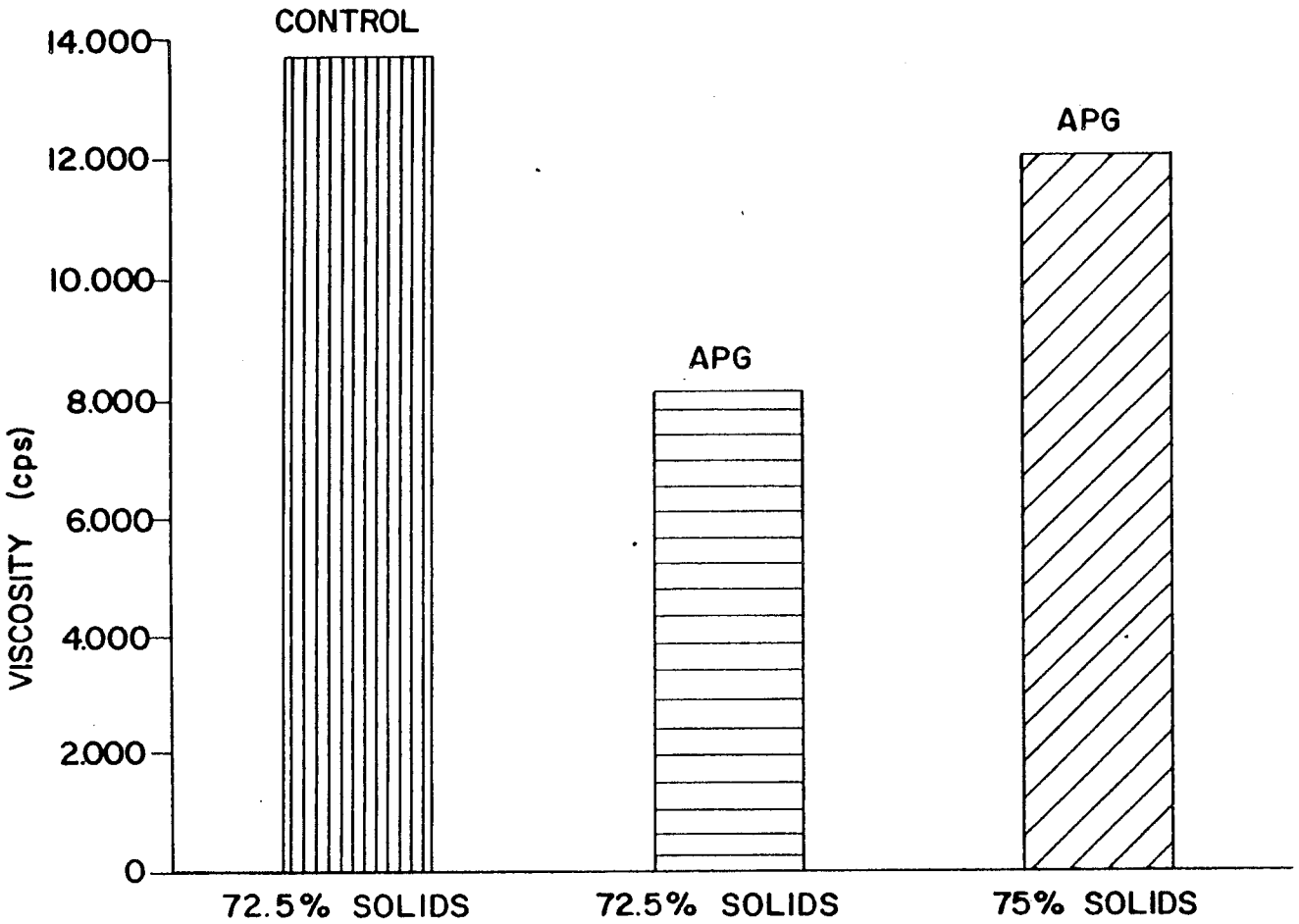
FIG. 4 is a bar graph illustrating the effect of alkali metal chloride and alkyl polyglucoside on the viscosity of a carbonate built detergent slurry containing a nonionic surfactant.

In the formulation, a portion of the sodium sulfate was replaced by the APG ® and sodium chloride. The amount of sodium sulfate was reduced and the amount of nonaqueous material in the slurry remained constant. The example clearly shows that the addition of APG ® and an alkali metal chloride substantially reduces the viscosity of a nonionic carbonate built detergent system. FIG. 4 clearly shows that a detergent slurry with a nonaqueous content of 75%, had a lower viscosity than the control with a nonaqueous portion of the slurry of 72.5% by weight.

Example 5

Twelve slurries were prepared containing different percentages of nonaqueous ingredients and the viscosity of the slurries determined after five minutes of high shear mixing and after 25 minutes of high shear mixing. The nonaqueous portion of the aqueous detergent slurry is shown in Table I.

The results of the experiments are shown in Table I. APG ® 225 refers to an alkylpolyglucoside with a 9-11 carbon alkyl group and x is 1.5-1.6. The other APG ® materials were as set forth in example 2.

TABLE I

Effect of APG Surfactants on Viscosity of Slurries Containing Anionic Surfactant and Sodium Carbonate

| % Total Solids | % KCl | % APG ® | Slurry Viscosity (Cps) Initial* | Final** |
|---|---|---|---|---|
| 62.5 | 0 | 0 | 6,500 | 8,000 |
| 68.0 | 0 | 0 | 7,500 | 11,600 |
| 72.0 | 0 | 0 | 44,200 | 66,200 |
| 72.0 | 0 | 2 | 34,000 | 68,000 |
| 72.0 | 5 | 0 | 58,000 | 60,000 |
| 72.0 | 5 | 2 (225) | 4,800 | 4,600 |
| 72.0 | 5 | 2 (325) | 4,100 | 4,700 |
| 72.0 | 5 | 2 (500) | 5,400 | 6,400 |
| 72.0 | 5 | 2 (550) | 5,100 | 5,400 |
| 74.0 | 0 | 0 | 63,000 | 98,000 |
| 74.0 | 5 | 2 (325) | 6,200 | 6,800 |
| 74.0 | 5 | 2 (500) | 6,200 | 13,200 |

*5 Min. High Shear Mixing
**25 Min. High Shear Mixing

Composition of Slurry (Dry Solids Basis)

| Raw Material | % |
|---|---|
| Anionic Surfactant (dodecylbenzenesulfonate sodium salt) | 15 |
| Sodium Carbonate | 55 |
| Sodium Sulfate | 16–23 |
| Sodium Silicate | 7 |
| Potassium Chloride | 0–5 |
| APG ® 500 Surfactant | 0–2 |

Example 6

The effect of APG ® and alkali metal chloride on the viscosity of slurries containing an anionic and nonionic surfactant and sodium carbonate was determined by preparing six slurries having a non-aqueous content of from 60.5 to 74%. Potassium chloride and APG ® were added to these slurries and the viscosity of the slurries determined. The slurries were prepared according to the method set forth above. The composition of the slurry (dry solid) is shown in Table II.

The results of the experiment are set forth in Table II. It can be seen from Table II that potassium chloride alone has a detrimental effect on the viscosity of the detergent slurry. Potassium chloride alone without APG ® increased the viscosity of the slurry.

In addition, the APG prevented oiling-out of the nonionic surfactant from the slurry composition. The prevention of the separation of nonionic surfactant from the detergent slurry is a valuable attribute of incorporation of the APG into the slurry composition.

Example 7

TABLE II

Effect of APG Surfactants on Viscosity of Slurries Containing Anionic and Nonionic Surfactants and Sodium Carbonate

| % Total Solids | % KCl | % APG ® | Slurry Viscosity (Cps) Initial* | Final** |
|---|---|---|---|---|
| 60.5 | 0 | 0 | 34,500 | 42,000 |
| 62.5 | 0 | 0 | 141,000 | 115,000 |
| 74.0 | 0 | 0 | >400,000 | |
| 74.0 | 5 | 0 | Set up solid | |
| 74.0 | 5 | 2 (325) | 13,200 | 15,500 |
| 74.0 | 5 | 2 (500) | 82,000 | 84,000 |

*5 Min. High Shear Mixing
**25 Min. High Shear Mixing

Composition of Slurry (Dry Solids Basis)

| Raw Material | % |
|---|---|
| Anionic Surfactant (dodecylbenzenesulfonate) sodium salt | 12 |
| Nonionic Surfactant | 4 |
| Sodium Carbonate | 55 |
| Sodium Sulfate | 15–22 |
| Sodium Silicate | 7 |
| Potassium Chloride | 0–5 |
| APG ® Surfactant | 0–2 |

Example 7

The effect of alkali metal chloride and APG ® on the viscosity of carbonate built nonionic surfactant detergent slurries is shown in Table III. The composition of the slurries is shown in the Table. The slurries were prepared as described above, and the viscosities measured as described above.

The combination of alkali metal chloride and APG ® reduced the viscosity of the slurries.

TABLE III

Effect of APG Surfactants on Viscosity of Slurries Containing Nonionic Surfactants and Sodium Carbonate

| % Total Solids | % KCl | % APG ® | Slurry Viscosity (Cps) Initial* | Final** |
|---|---|---|---|---|
| 72.5 | 0 | 0 | 10,800[1] | 13,700 |
| 72.5 | 5 | 0 | 33,000[1] | 29,400 |
| 72.5 | 5 | 2 | 7,000 | 8,200 |
| 75.0 | 5 | 2 | 13,000 | 12,100 |
| 77.0 | 5 | 2 | 64,000 | 43,700 |

*5 Min. High Shear Mixing
**25 Min. High Shear Mixing
[1]Nonionic surfactant separated out.

Composition of Slurry (Dry Solids Basis)

| Raw Material | % |
|---|---|
| Nonionic Surfactant (Neodol 25-7) | 12 |
| Sodium Carbonate | 55 |
| Sodium Sulfate | 19–26 |
| Sodium Silicate | 7 |
| Potassium Chloride | 0–5 |
| APG ® 500 Surfactant | 0–2 |

Example 8

Slurries were prepared to determine the effect of degree of ethoxylation of the APG polyglucoside on the viscosity of an aqueous detergent slurry. The composition of the slurry is shown in Table IV.

The viscosities of the slurries prepared as described above are set forth in Table IV.

It is clear from Table IV that up to about 1 mol of ethylene oxide per APG ® molecule can be used.

The examples clearly show that the addition of small amounts of APG ® and an alkali metal chloride to a carbonate built aqueous detergent slurry substantially reduces the viscosity of the slurry. The reduction is important since a slurry having a higher concentration of non-aqueous materials can be prepared and dried with a lower input of heat. This permits the capacity of the drier to be increased or the particulate detergent composition to be prepared with a lower input of energy per unit weight.

The above examples are for illustrative purposes only, and are not intended to limit the scope of the invention.

Typical detergent formulations which aqueous slurrys can be improved by the addition of small amounts of an alkali metal chloride and an APG ® are as follows:

Anionic surfactant 5–30% by weight
carbonate 15–70% by weight
Sodium sulfate 0–60% by weight
Sodium chloride 0–25% by weight
Sodium silicate 3–25% by weight
Alkyl polyglucosides 0.5–10% by weight Anionic surfactant-nonionic surfactant containing formulations are becoming more popular due to the attractive properties of the anionic and nonionic surfactants when they are combined in a detergent. A detergent containing an anionic and a nonionic surfactant would be shown above with the addition of from about 3–15% of the nonionic surfactant. If an allnonionic surfactant detergent is desired, the anionic surfactant can be replaced in the above formulation by about 3–15% of a nonionic surfactant. The addition of APG ® and an alkali metal chloride to the composition, if the composition does not already contain an alkali metal chloride will substantially reduce the viscosity of an aqueous slurry of the detergent.

A typical anionic-nonionic formulation would be as follows:

| Component | % Non-Aqueous Composition by Weight |
|---|---|
| Anionic Surfactant | 8–15% |
| Nonionic Surfactant | 2–10% |
| Sodium Carbonate | 45–65% |
| Sodium Silicate | 3–10% |
| Soap | 0–5% |
| Carboxymethyl Cellulose (antiredeposition agent) | 0.25–1% |
| Optical brightener | .25–1.0% |
| Sodium chloride | 2–10% |
| APG ® | 1–10% |
| $Na_2SO_4$ | 0–30% |

TABLE IV

Effect of Ethoxylated APG Surfactants on Viscosity of Slurries Containing Anionic Surfactants and Sodium Carbonate

| % Total Solids | % KCl | % APG (500) | Moles EO | Slurry Viscosity (Cps) Initial* | Final** |
|---|---|---|---|---|---|
| 72 | 0 | 0 | 0 | 44,200 | 66,200 |
| 72 | 5 | 3 | 0 | 12,300 | 14,000 |
| 72 | 5 | 3 | 0.5 | 18,000 | 22,500 |
| 72 | 5 | 3 | 2.0 | 400,000 | — |

*5 Min. High Shear Mixing
**25 Min. High Shear Mixing

| Composition of Slurry (Dry Solids Basis) Raw Material | % |
|---|---|
| Anionic Surfactant | 15 |
| Sodium Carbonate | 55 |
| Sodium Sulfate | 16–23 |
| Sodium Silicate | 7 |
| Potassium Chloride | 0–5 |
| APG ® 500 Surfactant | 0–3 |

Example 9

Four sodium carbonate built detergent slurries were prepared containing sodium tripolyphosphate. The slurries were prepared as described above and the viscosities measured as described. The combination of alkali metal chloride and an alkyl polyglucoside were effective in reducing the viscosity of the slurries. The addition of potassium chloride alone substantially increased the viscosity of the slurry.

The results of the experiments are shown in Table V.

TABLE V

Viscosity Reduction of Crutcher Slurries Containing Carbonate, Sulfate and Phosphate Composition (Dry Solids Basis)

| | 1 | 2 | 3 | 4 |
|---|---|---|---|---|
| % NaLAS | 15 | 15 | 15 | 15 |
| % $Na_2CO_3$ | 25 | 25 | 23 | 25 |
| % $Na_2SO_4$ | 33 | 30 | 30 | 31 |
| % STP* | 20 | 20 | 20 | 20 |
| % Silicate | 7 | 7 | 7 | 7 |
| % KCl | 0 | 3 | 3 | 0 |
| % APG ® 500 | 0 | 0 | 2 | 2 |
| Viscosity (72.5% Solids 25 Minutes) | 100,000 | 230,000 | 23,000 | 30,000 |

*Light Density Granular Sodium Tripolyphosphate from FMC Corp.

Example 10

Four slurries were prepared containing a large proportion of zeolite A. Two of the slurries contained sodium tripolyphosphate. All of the slurries contained sodium carbonate. The addition of alkali metal chloride and APG ® to the slurries reduced the viscosity of the slurries.

The results of the experiments are shown in Table VI.

TABLE VI

Viscosity Reduction of Crutcher Slurries Containing Carbonates, Sulfates, Zeolites and/or Phosphate Composition (Dry Solids Basis)

| | 1 | 2 | 3 | 4 |
|---|---|---|---|---|
| % NaLAS | 15 | 15 | 15 | 15 |
| % $Na_2CO_3$ | 25 | 23 | 12 | 10 |
| % $Na_2SO_4$ | 28 | 25 | 16 | 13 |
| % Zeolite A | 25 | 25 | 25 | 25 |
| % STP* | 0 | 0 | 25 | 25 |
| % Silicate | 7 | 7 | 7 | 7 |
| % KCl | 0 | 3 | 0 | 3 |
| % APG ® 500 | 0 | 2 | 0 | 2 |
| Viscosity (72.5% Solids 25 Minutes) | 47,000 | 42,000 | 280,000 | 82,000 |

*Light Density Granular Sodium Tripolyphosphate from FMC Corp.

Example 11

Slurries were prepared utilizing sulfated and carboxylated alkyl polyglucoside derivatives as described above. The viscosities were determined as described.

The results of the experiments are shown in Table VII. The addition of small amounts of alkali metal chloride and the alkyl polyglucoside to the slurry substantially reduced the viscosity of the slurries.

The invention has been described by way of specific embodiments. The specific embodiments disclosed are not intended to limit the invention.

TABLE VII

Viscosity Reduction of Crutcher Slurries Using APG ® Derivatives Composition (Dry Solids Basis)

| | 1 | 2 | 3 | 4 | 5 |
|---|---|---|---|---|---|
| % NaLAS | 15 | 15 | 15 | 15 | 15 |

TABLE VII-continued

| Viscosity Reduction of Crutcher Slurries Using APG ® Derivatives Composition (Dry Solids Basis) | | | | | |
|---|---|---|---|---|---|
| | 1 | 2 | 3 | 4 | 5 |
| % $Na_2CO_3$ | 55 | 53 | 53 | 53 | 53 |
| % $Na_2SO_4$ | 23 | 20 | 20 | 20 | 20 |
| % Silicate | 7 | 7 | 7 | 7 | 7 |
| % KCL | 0 | 3 | 3 | 3 | 3 |
| % APG ® | | | | | |
| 83VV-137D* | 0 | 2 | | | |
| 26XX-18 | | | 2 | | |
| 2VV-88-2 | | | | 2 | |
| XP8E-A96 | | | | | 2 |
| Viscosity (72.5% Solids) | 92,000 | 44,500 | 31,000 | 53,000 | 21,000 |

*83VV-137D APG ® 500 Sulfated with 0.25 equivalent per APG ® molecule.
26XX-18 APG ® 500 Sulfated with 2.0 equivalent per APG ® molecule.
2VV-88-2 APG ® 500 Carboxylated with 1.0 equivalent per APG ® molecule.
XP8E-A96 APG ® 500 made with $C_{12}$–$C_{13}$ Alcohol (Neodol 23) and has an average DP of 1.3–1.4

We claim:

1. A process for preparing a particulate detergent composition which comprises:

A. forming an aqueous slurry comprising, per 100 parts per total slurry weight;

1. from about 15 to about 50 parts by weight of water; and
2. from about 50 to about 85 parts by weight of nonaqueous ingredients, the non-aqueous ingredients comprising:
   a. from about 3 to 50% by weight of an anionic surfactant, nonionic surfactant or mixture thereof;
   b. from about 10 to about 70% by weight of an alkali metal carbonate builder;
   c. from about 0 to 50% by weight of at least one supplemental builder;
   d. from about 0 to about 60% by weight of at least one filler;
   e. from about 0 to about 15% by weight of at least one additive; and
   f. at least a viscosity reducing amount of an alkyl polyglycoside and an alkali metal chloride;

B. drying the slurry to form the particulate detergent composition.

2. A process of claim 1 wherein the viscosity reducing amount of an alkyl polyglycoside and an alkali metal chloride comprises from about 0.5 to about 10% by weight of at least one alkali metal chloride selected from a group consisting of sodium chloride and potassium chloride.

3. A composition of claim 1 wherein the non-aqueous ingredients comprise about 8 to about 25 percent by weight of at least one surfactant selected from the group consisting of anionic surfactants and nonionic surfactants; from about 25 to about 60% by weight of sodium carbonate, from about 10 to about 40 percent by weight of at least one additional builder, from about 15–35% by weight of sodium sulfate; from about 0.5 to about 5% of additives; from 0.5 to about 10% by weight of an alkyl polyglucoside and from about 0.5 to about 10 percent by weight of at least one alkali metal chloride selected from the group consisting of sodium chloride and potassium chloride.

4. A process of claim 1 wherein the alkyl polyglycoside is a composition of the formula $$RO—IR^{1}0)_y(G)_xZ_b$$

wherein

R is a monovalent organic radical containing from about 6 to about 30 carbon atoms;

$R^1$ is a divalent aliphatic hydrocarbon radical containing from 2 to 4 carbon atoms;

0 is oxygen;

y is a number which has an average value of 0 to about 1 and is preferably 0;

G is moiety derived from a reducing saccharide containing 5 to 6 carbon atoms;

x is a number having an average value of from about 1 to about 5;

Z is $O_2M$, $$O—\overset{\overset{\displaystyle O}{\|}}{C}—R^2,$$

$O(CH_2)_pCO_2M$, $OSO_3M$, $O(CH_2)_pSO_3M$ wherein $R^2$ is $(CH_2)_2CO_2M$ or $CH{=}CHCO_2M$ and Z can be $O_2M$ only if Z is in place of a primary hydroxyl group in which the primary hydroxyl-bearing carbon atom, $—CH_2OH$ is oxidized to form a $$—\overset{\overset{\displaystyle O}{\|}}{C}—OM$$

group.

b is a number from 1 to 3X+1;

p is 1 to 10; and M is $H^+$ or an organic or inorganic cation.

5. A process of claim 4 wherein the alkyl polyglycoside is an alkyl polyglucoside.

6. A process of claim 2 wherein the alkyl polyglycoside is an alkyl polyglucoside.

7. The process of claim 1 wherein the slurry is spray dried.

8. A particulate detergent composition which nonaqueous ingredients comprises:

a. from about 3 to about 50% by weight of an anionic surfactant, nonionic surfactant and mixtures thereof;
b. from about 10 to about 70% by weight of an alkali metal carbonate builder;
c. from about 0 to 60% by weight of at least one supplemental builder;
d. from about 0 to about 60% by weight of at least one filler;
e. from about 0 to about 15% by weight of at least one additive; and
f. from about 0.5 to about 25% by weight of an alkyl polyglycoside and from about 0.5 to about 35% by weight of at least one alkali metal chloride.

9. A composition of claim 8 wherein the composition contains from about 0.5 to about 10% by weight of an alkyl polyglycoside and from about 0.5 to about 10% by weight of at least one alkali metal chloride.

10. A process of claim 8 wherein the alkyl polyglycoside is a composition of the formula $$RO—(R^{1}0)_y(G)_xZ_b$$

about 6 to about 30 carbon atoms;

$R^1$ is a divalent aliphatic hydrocarbon radical containing from 2 to 4 carbon atoms;

O is oxygen;

y is a number which has an average value of 0 to about 1 and is preferably 0;

G is moiety derived from a reducing saccharide containing 5 or 6 carbon atoms;

x is a number having an average value of from about 1 to about 5;

Z is $O_2M$,

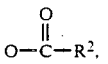

$O(CH_2)_pCO_2M$, $OSO_3M$, $O(CH_2)_pSO_3M$ wherein $R^2$ is $(CH_2)_2CO_2M$ or $CH{=}CHCO_2M$ and Z can be $O_2M$ only is Z is in place of a primary hydroxyl group in which the primary hydroxyl-bearing carbon atom, $-CH_2OH$ is oxidized to form a

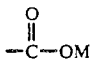

group.

b is a number from 1 to 3X+1;

is 1 to 10; and M is H+or an organic or inorganic cation.

11. A detergent composition of claim 9 wherein the alkyl polyglycoside is an alkyl polyglucoside.

12. A method of claim 1 wherein the supplemental builder comprises a zeolite.

13. A method of claim 1 wherein the supplemental builder comprises not more than about 20% by weight of a phosphate builder.

14. A composition of claim 8 containing a zeolite as a supplemental builder.

15. A composition of claim 8 containing not more than about 20% by weight of a phosphate builder as a supplemental builder.

16. An aqueous slurry comprising from about 15 to about 50 parts by weight of water and from about 50 to about 85 parts by weight of the detergent composition of claim 8.

17. A method of claim 1 wherein the aqueous slurry comprises from about 15% to about 60% by weight of the non-aqueous portion of the slurry of sodium sulfate.

18. A method of claim 17 containing from 15% to 35% by weight of the non-aqueous portion of the slurry of sodium sulfate.

19. A composition of claim 8 comprising from about 15% to 60% by weight of sodium sulfate.

20. A composition of claim 19 containing from 15% to about 35% by weight of sodium sulfate.

* * * * *

UNITED STATES PATENT AND TRADEMARK OFFICE

CERTIFICATE OF CORRECTION

PATENT NO. :5,118,439

DATED :June 2, 1992

INVENTOR(S) :Allen D. Urfer, et. al.

It is certified that error appears in the above-indentified patent and that said Letters Patent is hereby corrected as shown below:

In claim 2, at column 15, line 49, after "weight of" add -- an alkyl polyglycoside and from 0.5 to about 10% by weight of--.

In claim 4, at column 15, line 68, the formula "RO-IR$^1$O)$_y$(G)$_x$Zb" should read-- RO-(R$^1$O)y(G)$_x$Zb--.

In claim 10, at column 16, line 64, add -- wherein R is a monovalent organic radical containing --.

In claim 10 at column 17, line 8, after $O_2M$ delete "." and enter --,--.

In claim 10, at column 17, line 26, " is 1 to 10;" should read -- p is 1 to 10; --.

In claim 10,at column 16, line 63, the formula "RO-(R$^1$O)y(G)$_x$Zb" should read -- RO-(R$^1$O)y(G)$_x$Zb--.

Signed and Sealed this

Twenty-eighth Day of September, 1993

Bruce Lehman

*Attest:*

BRUCE LEHMAN

*Attesting Officer*

*Commissioner of Patents and Trademarks*